United States Patent [19]

Melendez

[11] 4,364,187

[45] Dec. 21, 1982

[54] SKATE SANDALS

[76] Inventor: Ricardo Melendez, P.O. Box 7000-287, Palos Verdes Peninsula, Calif. 90274

[21] Appl. No.: 203,645

[22] Filed: Nov. 3, 1980

[51] Int. Cl.[3] ..... A43B 3/24; A43C 13/00; A43B 3/10

[52] U.S. Cl. ..... 36/15; 36/100; 36/7.5; 280/825

[58] Field of Search ..... 36/100, 101, 15, 7.5, 36/7.6, 135; 280/11.1 R, 825, 809, 11.19

[56] References Cited

U.S. PATENT DOCUMENTS 2,828,967 4/1958 Vassanelli ..... 280/825

3,898,749 8/1975 Famolare ..... 36/100

4,258,483 3/1981 Hogue ..... 36/135

FOREIGN PATENT DOCUMENTS 204456 7/1959 Austria ..... 280/11.1 R 266559 10/1913 Fed. Rep. of Germany ..280/11.1 R

*Primary Examiner*—Patrick D. Lawson

[57] ABSTRACT

A device to be detachably connected to a roller skate having wheels to facilitate walking including a bottom portion held onto the skate with spring clips. An enclosing wall extends up from the bottom portion to shield the clips and wheels from view.

10 Claims, 4 Drawing Figures

FIG. 1
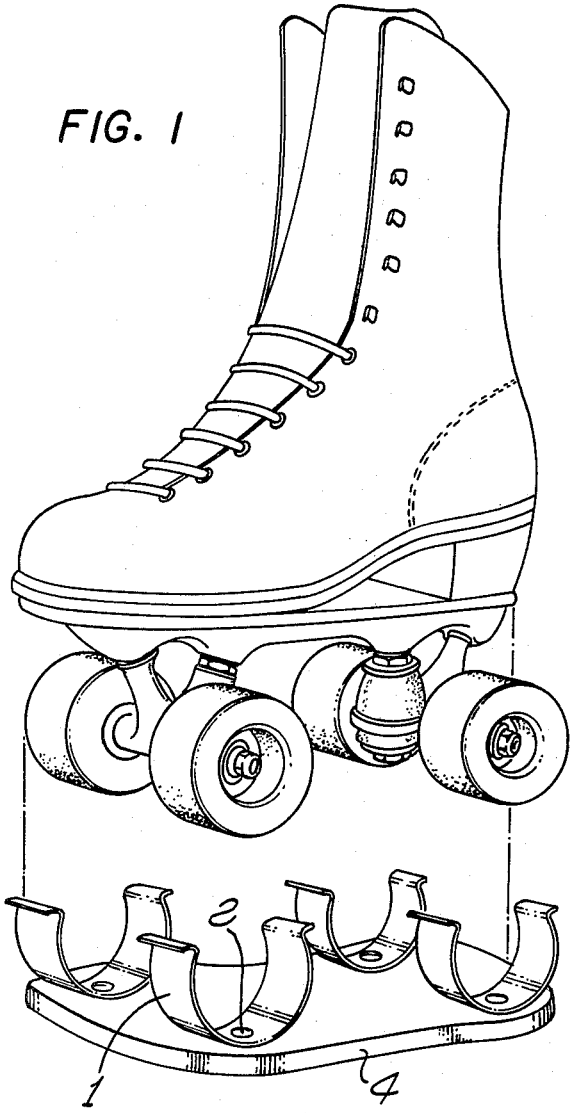
FIG. 2
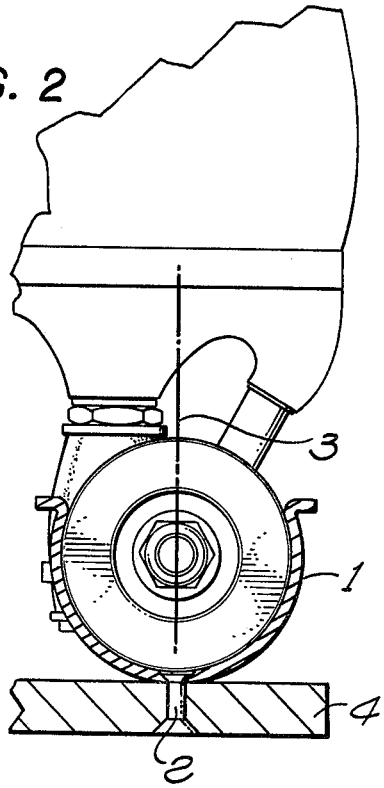
FIG. 4
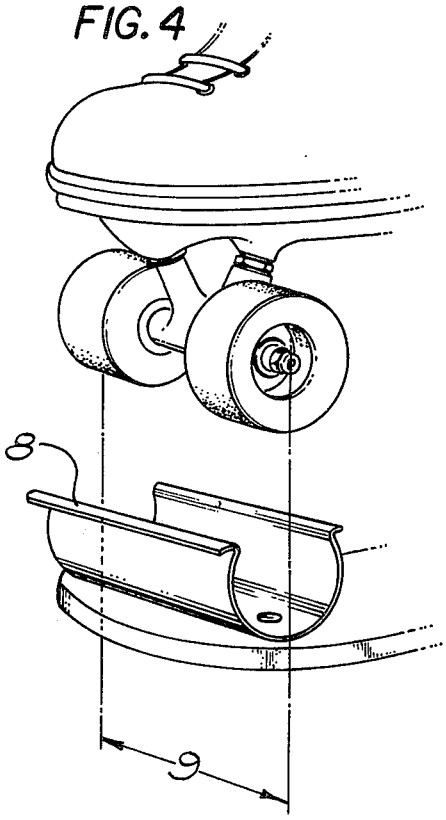
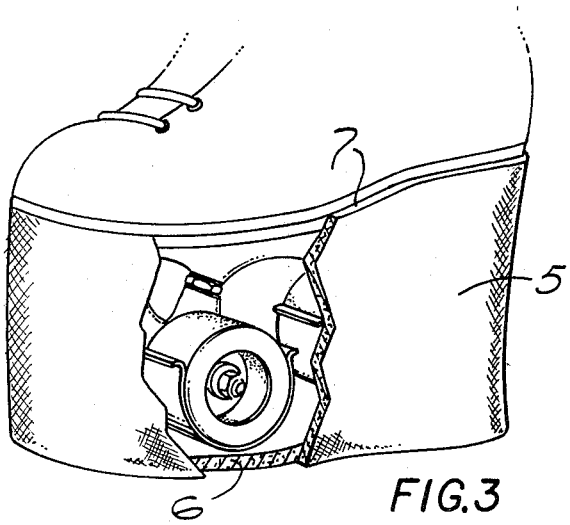
FIG.3

SKATE SANDALS

This invention is a new and useful accessory for roller skates. It's primary objective is to provide roller skaters a simple and economical means whereby they can easily and temporarily convert their roller skates into shoes.

Since it is not uncommon for roller skaters to do such things as eat, stand or walk etc. on their skates, the means to temporarily convert their skates into shoes, when not skating, will provide them with increased safety and stability, until such time as they decide to resume skating.

These objectives, which will subsequently become apparent, reside in the details of construction and operation as more fully, hereinafter described and claimed, reference being made to the accompanying drawings in which like numerals refer to like parts.

FIG. 1 is a drawing of the SKATE SANDAL itself, positioned underneath the skate showing how it will be attached.

FIG. 2 is a picture showing how a clip looks when attached to the skate wheel.

FIG. 3 shows the optional fashionable cover.

FIG. 4 shows one modification, where two large clips instead of four small ones are used to attach the shoe sole to the skate wheels.

Refering now to the drawing in detail, number 1 of FIG. 1 consists of four spring (expansive) clips, each of which is the width of the skate wheel for maximum strength and stability.

Each spring clip 1 is attached to a single shoe sole 4 by means of a rivet 2 or other permanent attachment.

FIG. 2 shows that the rivet 2 is attached to the shoe sole 4 in such a way, so as to line up with the axis 3 of the skate wheel (again, for maximum strength and stability). When the wheel is pushed into the clip 1, the clip will expand and snap over the wheel, therefore holding it.

So the main purpose of the spring clips 1 is to allow the shoe sole to be easily and temporarily snapped into the four skate wheels, and then to be easily unsnapped when the skater is ready to resume skating.

When the sole is attached to the wheels, it will provide stability to the skater, whereby he can now comfortably stand and walk (even run) etc, with less chance of falling and therefore increased safety when not skating.

Number 5 of FIG. 3 shows an optional, stiff and fashionable covering that is permanently attached to the shoe sole 6, and extends up to the bottom edge of the skate's sole 7. The wheels will then fit into this cavity, and snap into the clips at the bottom, wheels and clips therefore being hidden from view.

One modification that could be made (number 8 of FIG. 4), would be to use two large expansive clips instead of four small ones. One clip would be for the two front wheels, and the other clip would be for the two rear wheels. The width of each of these large clips would be the same width as measured from the outside edge of the left front wheel to the outside edge of the right front wheel (number 9 of FIG. 4).

Thus the SKATE SANDAL is simply a detachable shoe sole useful for the comfort and safety of the skater, and may even be of a fasionable appearance.

The foregoing is considered as illustrative only of the principals of the invention. Since numerous modifications and changes will readily occur to those skilled in the art, it is not desired to limit the invention to the exact construction and operation shown and described, and accordingly, all suitable modifications and equivalents may be considered as falling within the scope of this invention as described and claimed.

What is claimed as new is as follows:

1. A device to be detachably connected to a roller skate having wheels to facilitate walking with the skate, said device comprising:

a bottom structure for contacting a floor surface as a person walks therealong with said device attached to a skate; and resilient spring clip means carried by said bottom structure at the upper side thereof to which a skate is connectible by movement of the skate downwardly relative to said device, and from which the skate is detachable by movement upwardly relative to said device;

said clip means containing and forming at least one upwardly facing and upwardly opening recess into which at least one wheel of the skate is movable downwardly upon said downward attaching movement of a skate relative to said device, with said clip means having a resiliently deflectable portion near the upper end of said recess positioned to be displaced generally horizontally by a skate wheel upon downward movement thereof and after passage of the wheel to resiliently return inwardly to a position yieldingly retaining the wheel in said recess.

2. A device as recited in claim 1, in which said clip means take the form of an essentially U-shaped upwardly facing element of spring material adapted to extend more than half way about a skate wheel in closely fitting relation.

3. A device as recited in claim 1, in which said bottom structure is a generally horizontally extending sole element for contacting a floor surface.

4. A device as recited in claim 1, in which said clip means include four upwardly facing spring clips positioned and constructed to receive and resiliently retain four wheels respectively of said skate.

5. A device as recited in claim 1, in which said clip means include an essentially U-shaped elongated spring clip of a length to receive and simultaneously snap onto both of two aligned skate wheels.

6. A device as recited in claim 1, including an enclosing wall structure extending upwardly from said bottom structure and about said clip means to shield the clip means and wheels from view.

7. A device as recited in claim 1, in which said bottom structure includes a generally horizontally extending sole element for contacting a floor surface, said clip means including four upwardly facing essentially U-shaped spring clips attached at lower central portions thereof to said sole element and adapted to embrace and resiliently retain four wheels respectively of a skate, each of said four clips being shaped to closely receive and confine therein an associated one of said wheels, and to extend more than half way about the wheel to resiliently retain it.

8. A device as recited in claim 7, including an enclosure element attached to said sole element and projecting upwardly from the periphery thereof about said clips to shield the clips and contacted skate wheels from view.

9. The combination comprising a device as recited in claim 1 and a roller skate attached thereto by said clip means.

10. The combination comprising a device as recited in claim 7 and a roller skate attached thereto by said clip means.

* * * * *